United States Patent [19]

Bryant, Jr. et al.

[11] 4,177,822

[45] Dec. 11, 1979

[54] TOBACCO COMPOSITION

[75] Inventors: Herman G. Bryant, Jr., Bahama; Vello Norman, Raleigh; Thomas B. Williams, Durham, all of N.C.

[73] Assignee: Liggett Group Inc., Durham, N.C.

[21] Appl. No.: 763,267

[22] Filed: Jan. 27, 1977

Related U.S. Application Data

[63] Continuation-in-part of Ser. No. 548,983, Feb. 11, 1975, abandoned, which is a continuation of Ser. No. 344,589, Mar. 26, 1973, abandoned.

[51] Int. Cl.[2] ..... A24B 15/02

[52] U.S. Cl. ..... 131/17 R; 131/140 R

[58] Field of Search ..... 131/15, 2 G, 17, 140 C, 131/140 R

[56] References Cited

U.S. PATENT DOCUMENTS 3,292,636 12/1966 Mays ..... 131/17 R

FOREIGN PATENT DOCUMENTS 841074 7/1960 United Kingdom ..... 131/17 R

*Primary Examiner*—Robert W. Michell
*Assistant Examiner*—V. Millin
*Attorney, Agent, or Firm*—Michael L. Hendershot; J. Bowen Ross, Jr.

[57] ABSTRACT

A smoking composition comprising tobacco and a catalytic agent for causing a decrease in the yield of polycyclic aromatic compounds arising from pyrolytic reactions of the composition, the agent being selected from the group consisting of finely divided unsupported metallic palladium or palladium salts which are heat decomposable into metallic palladium.

9 Claims, No Drawings

TOBACCO COMPOSITION

This application is a continuation-in-part application of pending application, Ser. No. 548,983, filed Feb. 11, 1975 now abandoned, which in turn is a continuation of application, Ser. No. 344,589,
filed Mar. 26, 1973 now abandoned.

DISCLOSURE OF THE INVENTION

This invention relates to a smoking composition containing tobacco and having a catalytic agent associated with the tobacco. More particularly, it relates to such compositions wherein the catalytic agent associated with the tobacco is finely divided metallic palladium or palladium salt.

Observations of the mechanism of combustion in tobacco compositions such as cigarettes, indicate that the smoke components responsible for biological activity are formed in the pyrolysis zone of the cigarette cone. This has led to a substantial amount of research aimed at reducing the proportion of these components in the smoke which is inhaled by a smoker. It has been proposed that zeolite materials be used to control or influence free radical formation in the pyrolysis zone and thereby cause alterations in the structure of the pyrolysis products formed in expectation of a reduction in their biological activity. An alternative suggested mechanism involves the participation of ionic species in the reformation process of smoke components. For example, U.S. Pat. No. 3,292,636 disclosed tobacco preparations in combination with crystalline zeolite molecular sieves such as L, X, Y or synthetic mordenite types, or naturally occurring faujasite materials, which sieves may contain any elemental metal having a vapor pressure below 1 atmosphere at 1,000° C. and possessing catalytic activity for organic conversion. In U.S. Pat. No. 3,572,348 there is disclosed a smoking composition comprising tobacco in association with a Y zeolite which is at least partially exchanged with zinc ions and may also contain catalytically active palladium metal within or on the alumino-silicate network. Such materials are disclosed to result in tobacco composition wherein vaporized and at least partially oxidized, but unidentified irritant materials, are rendered less irritable to the smoker while the tobacco composition is being consumed. Also, the polycyclic aromatic hydrocarbon content arising from the pyrolytic reaction of these compositions has been found to be reduced by the catalytic activity of the Y zeolite disclosed therein.

It has now been found that a significant decrease in the polycyclic aromatic hydrocarbon content of the pyrolysis reaction products of tobacco-containing smoking compositions can be achieved by admixture with the tobacco of catalytic quantities of unsupported metallic palladium or palladium salts which are decomposable into metallic palladium. Tests performed with cigarettes indicate that these materials, when combined in catalytic association with tobacco result in the polycyclic aromatic hydrocarbon content of the cigarette smoke being reduced by at least 25% over that of control cigarettes in which palladium has not been associated with the tobacco thereof. In the present invention, the use of palladium provides a material which is highly effective for the purpose of achieving a significant lowering of the polycyclic aromatic content in the pyrolysis reaction products of tobacco-containing compositions as measured in the smoke produced when such a preparation is burned in air. The present invention comprises application of this surprising discovery to cigarettes, cigars, tobacco and other smoking tobacco compositions.

Accordingly, it is an object of this invention to provide a smoking tobacco composition which on burning substantially reduces the level of polycyclic aromatic compounds in smoke.

Other objects will be apparent from the disclosure and appended claims.

According to this invention, a novel smoking composition is provided which comprises tobacco, and a catalytic agent for decreasing the yield of polycyclic aromatic compounds arising from pyrolytic reactions of the composition, said agent consisting essentially of finely divided unsupported palladium or palladium salts which are decomposable, preferably by heat, directly or indirectly into metallic palladium.

One form of palladium which has been found to be particularly effective in combination with tobacco to provide the smoking composition of this invention is palladium black (Engelhard Industries, Inc.). The particle size of the palladium is finer than about 100 U.S. mesh.

The proportion of palladium associated with the tobacco in the smoking composition is at least about 0.001% by weight of the tobacco used to prepare the smoking composition which may include various additives as hereinafter described. The upper proportional quantity of palladium is about 1% by weight. Although the reduced yield of polycyclic compounds arising from pyrolytic reactions of the composition have been achieved within these levels, it has been found that the best results are obtained when the palladium is in the preferred range of about 0.01%-0.1% based upon the weight of the tobacco.

The catalytic agent should be well dispersed throughout the tobacco so that it will be uniformly effective during the entire period during which the composition is smoked. Furthermore, it is important to ensure that the dispersion effectively contacts a maximum volume of smoke which is inhaled by the user. Since the catalytic activity of the palladium is presently believed to be a surface phenomenon, the greatest likelihood of maximum contact between the smoke being drawn in by the user and the palladium is obtained when the area/volume ratio of the palladium particles is maximized for a given weight of palladium. For this reason, the palladium is preferably employed as a fine powder of particle size smaller than about 100 U.S. mesh.

Palladium salts which are decomposable directly or indirectly into metallic palladium may also be used. Decomposition of the palladium salt generally proceeds by heat decomposition in the pyrolytic cone or in the area ahead of it in the burning tobacco product. Accordingly, the palladium salt should be heat decomposable to palladium metal within the temperature range generally found in burning tobacco products. Preferably, water-soluble palladium salts such as chlorides, nitrates, hexachloropalladates, tetrachloropalladates or diamine complexes of palladium can be used. The soluble salts have the advantage that they can be applied as a dilute solution which facilitates the achievement of good dispersion throughout the tobacco matrix.

Ammonium hexachloropalladate, $(NH_4)_2PdCl_6$, (Engelhard Industries, Inc.) has been found to be particularly appropriate for this mode of application.

One method of application of the palladium to the tobacco is to dry blend the palladium, ground tobacco, a fibrous material and a binder. Dry blending, as in a conventional double cone blender effectively distributes the palladium over the surface of the tobacco, including the pores within the tobacco surface which are large enough to accept the palladium particles.

When required, dry blending is followed by wet mixing with water and casing materials in proportions sufficient to provide the resulting mixture with the appropriate consistency for conventional reconstituted tobacco sheet manufacturing operations. The sheet is then cut into strips and used in cigarette manufacture as such, or it can be blended in any desired proportion with regular tobacco.

The fibrous material which is a constituent of the dry blend can be, for example, α-cellulose or fibrous tobacco stem material. The binder portion of the dry blend may be sodium carboxymethyl cellulose, or a natural gum such as guar gum. The casing materials used in the wet mixing step are usually glycerin and propylene glycol. Of course, any other known fibrous material, binding or casing materials known to be useful in combination with tobacco products can be used in combination with or in place of those herein set forth.

Alternatively, palladium can be suspended in casing solution and applied directly on cut blended tobacco and manufactured into cigarettes or other products in this form.

When a solution of palladium salts is used it can be applied simultaneously or mixed with the casing solution.

The weight proportions of the additives described above for use in reconstituted tobacco sheets are generally within the following approximate weight ranges. The proportions shown are within the usual range required to provide useful tobacco products. However, the proportions shown may vary as necessary for a particular tobacco product in accordance with art recognized needs.

TABLE I

| MATERIAL | WEIGHT % |
|---|---|
| Fibrous | 4-8 |
| Binder | 1-20 |
| Casing | about 3-9 |
| Comprising: | |
| (a) Glycerin | 2.5-6 |
| (b) propylene glycol | 0.5-3 |
| Tobacco | balance to 100% |

The smoking composition may be further processed and formed into any desired shape or used loosely e.g., cigars, cigarettes, and pipe tobacco in a manner well-known to those skilled in the tobacco art.

The invention will be more clearly understood from the following examples which are provided by way of illustration and not limitation and in which the proportions are in parts by weight unless otherwise stated.

EXAMPLE 1

0.04 lbs. of palladium black (less than 100 mesh) was added to a mixture of 140 lbs. of ground strip tobacco blend, 12.4 lbs. of Solka Floc (α-cellulose) and 6.5 lbs. of sodium carboxymethyl cellulose. This combination was dry-mixed for one hour in a double cone blender and then wet-mixed in a paddle mixer with 1.08 gal. of glycerine, 0.33 gal. of propylene glycol and 8 gal. of water. The resulting damp mixture was processed in conventional reconstituted tobacco making equipment at the rate of 600 lbs./hour. The resulting sheet, at 12% moisture level, was cut at 32 cuts/inch and fabricated into cigarettes on conventional cigarette making machinery. The palladium content was about 0.02%.

Control cigarettes were prepared in like manner except that the palladium was omitted.

EXAMPLE 2

30 g of palladium black (less than 100 mesh) was blended in a porcelain pebble mill with 6600 g of commercial casing solution and the mixture was applied to cut blend with a conventional casing applicator. The finished blend containing about 0.06% of palladium was fabricated into cigarettes on standard cigarette making machinery.

EXAMPLE 3

1 g of $(NH_4)_2PdCl_6$ was dissolved in 500 ml of water and applied to 500 g of cut and cased tobacco blend with a conventional casing applicator with intermittent drying. The finished blend was dried to 12% moisture content and contained 0.06% of palladium.

Approximately 200 g samples of the blends prepared in accordance with Examples 1, 2 and 3 were pyrolyzed in an apparatus designed to simulate the cigarette cone and compared to the control blend in order to determine the effect of the palladium on the polycyclic aromatic hydrocarbon content of the pyrolysate. The test results are shown in Table II.

TABLE II

| | Control | $Pd^0$ (Ex. 1) | $Pd^0$ (Ex. 2) | $(NH_4)_2PdCl_6$ Ex. 3 |
|---|---|---|---|---|
| Pd (%) | — | 0.02 | 0.06 | 0.06 |
| Polycyclic Aromatic Hydrocarbons in Pyrolyzate/Total Dry Solids | | | | |
| Relative Infra-red* | 100 | 41 | 51 | 68 |

*IR spectral absorption in the region of aromatic C—H bonding vibrations (11.9-14.0μ).

Cigarettes fabricated in accordance with the procedure of Examples 1 and 2 were also tested and compared with control cigarettes. All test cigarettes were 85 mm long and were wrapped in cigarette paper having a Greiner porosity of 22 seconds. Test results are shown in Table III.

TABLE III

| | Control | Example 4 (Ex. 1) | Example 5 (Ex. 2) |
|---|---|---|---|
| Pd (%) | — | 0.02 | 0.06 |
| Polycyclic Aromatic Hydrocarbons in Smoke Drawn through the Cigarette/Total Dry Smoke | | | |
| Relative Infra-red* | 100 | 66 | 71 |

*IR spectral absorption in the region of aromatic C—H bonding vibrations (11.9-14.0 μ).

It is observed that the yield of polycyclic aromatic hydrocarbons decreased relative to the control by 29%-59%.

The above difference in effectiveness between the 0.02 and 0.06 weight percent concentrations of palladium black would appear to be anomalous on initial observation. However, the method of sample preparation used in Example 1, is a more efficient means for effecting catalyst distribution, as the additive is dispersed not only on the surface, but throughout the tobacco matrix. Although the palladium concentration was greater in Example 2, the degree of catalyst distribution in the blend was much less, therefore the catalytic efficiency of the palladium would be expected to be much less.

It has been observed that the $(NH_4)_2PdCl_6$ compound, used in Example 3, when dissolved in the water and/or the casing solution and before it is applied to the tobacco is reduced to the $Pd^{++}$ state. This takes place by the followng hydrolysis reaction:

$$(NH_4)_2PdCl_6 \xrightarrow{H_2O} 2NH_4^+ + Pd(Cl)_x(OH)_y^= + Cl_2$$

Were one to remove the water from this aqueous solution one would have the salt $(NH_4)_2PdCl_4$. Evidence for this has been obtained by comparison of the ultraviolet spectra of aqueous solutions of the $(NH_4)_2PdCl_6$ and $(NH_4)_2PdCl_4$ and from infrared spectral analysis of the salts precipitated from the aqueous solutions of both salts. In both instances the spectra for each salt were identical.

This is further confirmed by the following examples which illustrate that the $(NH_4)_2PdCl_6$ and $(NH_4)_2PdCl_4$ salts function the same in the practice of the present invention.

EXAMPLE 6

0.8 gram (gm) of $(NH_4)_2PdCl_4$ was dissolved in 5 gms of water and 56.56 gms of a commercial casing solution. This mixture was then applied to 400 gms of a commercial blend of cut-strip tobaccos with a conventional casing applicator. The cased tobacco was intermittently dried to a moisture content of about 12 weight percent. The finished product contained 0.06 weight percent, calculated as palladium metal, of the added salt.

EXAMPLE 7

The same equipment and procedure used in Example 6 were used except 1.0 gm of $(NH_4)_2PdCl_6$, 50 gms of water and 56.56 gms of a commerical casing solution, were mixed and applied to 400 gms of a commercial blend of cut-strip tobaccos. The cased tobacco was dried to a moisture content of 12 weight percent. The finished product contained 0.06 weight percent, calculated as palladium metal, of the added salt.

A Control for Examples 6 and 7 was prepared using the same equipment, materials and procedure except the palladium salt was omitted.

EXAMPLES 8 and 9

The same equipment, materials and procedure used in Example 6 were used to make duplicate samples of Examples 6 and 7 except the additives in the casing solution were applied to a blend of tobaccos which had a native nitrate nitrogen concentration of 0.59 weight percent and the weight percent of palladium in the final blend was 0.05% calculated as palladium metal. The native nitrate nitrogen concentration of the tobacco blend used in Examples 6 and 7 is 0.10 weight percent.

A Control for Examples 7 and 8 was prepared using the same equipment, materials and procedure except the palladium salt was omitted.

Approximately 200 gms of each of the six samples prepared in accordance with the procedures for Examples 6 through 9 and their respective Controls were pyrolyzed in an apparatus designed to simulate the cigarette cone under burning conditions. Smoke condensate was collected from each of the three blends by conventional cold trap procedure. The PCAH fraction of the total dry solids (TDS) of smoke condensate collected was obtained by liquid column chromatography using two separate extractions of the collected smoke with a mixture of 6 percent, by volume, benzene in hexane as the eluant. The first extraction used alumina as the absorbent while silica gel was used for the second extraction. The results for these examples are reported below as Relative weights of mgm PCAH/gmTDS. The value obtained for each example was divided by the value obtained for the control and the result multiplied by 100. The results are reported below in Table IV.

TABLE IV

| Example | Additive | % Pd* | Native Nitrate Nitrogen, %** | Relative PCAH/TDS |
|---|---|---|---|---|
| Control | — | — | 0.10 | 100 |
| 6 | $(NH_4)_2PdCl_4$ | .06 | 0.10 | 78 |
| 7 | $(NH_4)_2PdCl_6$ | .06 | 0.10 | 62*** |
| Control | — | — | 0.59 | 100 |
| 8 | $(NH_4)_2PdCl_4$ | .05 | 0.59 | 72 |
| 9 | $(NH_4)_2PdCl_6$ | .05 | 0.59 | 74 |

*Concentration of additive in blend, calculated as palladium metal.
**Weight % Native Nitrate Nitrogen in Tobacco blend used to prepare sample.
***Average of two sample runs at these conditions.

The following examples illustrate the uniqueness of the palladium salt form when compared with platinum under the conditions tested.

EXAMPLES 10 THROUGH 14

The same equipment, tobacco blend and procedure used in Example 6 were used except sufficient amounts of $(NH_3)_2Pd(NO_2)_2$ and $(NH_3)_2Pt(NO_2)_2$ were added to the tobacco to give final concentrations of 0.06 and 0.10 weight percents, calculated as metal, for both the platinum and palladium salts. A Control for these four samples was prepared using the same method and equipment except the metal was omitted.

Each of the above samples were dried to a moisture content of about 12 weight percent and the smoke condensate was collected by the same method and apparatus described in Example 6. The results are reported in the Table V.

The following samples illustrate the effectiveness of palladium metal when compared with platinum metal, under the conditions tested.

EXAMPLES 15 THROUGH 17

0.3 grams of palladium black or platinum black metal was dispersed in 71 grams of a casing solution of glycerin and propylene glycol and applied in a conventional casing applicator to 500 grams of a conventional blend of burley, bright and turkish tobaccos. The mixture was intermittently dried to a moisture content of tweleve (12) weight percent. The finished product blends contained 0.06 weight percent of metallic palladium (Example 15) and platinum (Example 16). The Control Composition (Example 17) had the metal omitted but was prepared in the same way.

The smoke condensate was collected from each of the three blends according to the procedure described in Example 6 and the results reported in Table V.

TABLE V

| Ex. | Additive | % Metal* | PCAH/TDS mgm/cm** | Relative PCAH/TDS*** |
|---|---|---|---|---|
| 10 | $(NH_3)_2Pd(NO_2)_2$ | .06 | 11.76 | 71 |
| 11 | $(NH_3)_2Pd(NO_2)_2$ | .10 | 9.15 | 55 |
| 12 | $(NH_3)_2Pt(NO_2)_2$ | .06 | 15.54 | 94 |
| 13 | $(NH_3)_2Pt(NO_2)_2$ | .10 | 15.53 | 94 |
| 14 | Control | — | 16.5 | 100 |
| 15 | Palladium black | .06 | 14.29 | 78 |
| 16 | Platinum black | .06 | 17.59 | 96 |
| 17 | Control | — | 18.32 | 100 |

*Weight percent additive, calculated as metal, in final tobacco blend

**milligrams of collected polycyclic aromatic hydrocarbon per gram of collected dry smoke.

*** $\frac{\text{PCAH/TDS for Sample, mgm/gm}}{\text{PCAH/TDS for Control, mgm/gm}} \times 100$ The following examples illustrate the effect of varying the concentration of the palladium in the tobacco blend in the practice of the present invention.

EXAMPLES 18 THROUGH 21

The same method, materials and procedure used in Example 15 were used except the palladium was added as $(NH_4)_2PdCl_6$ which had been dissolved in 500 ml. of water and premixed with the casing solution before application to the tobacco. In Examples 18 through 21 predetermined amounts of $(NH_4)_2PdCl_6$ reported in Table VI were dissolved in the water to give the desired concentrations of palladium in the final blend.

EXAMPLES 22 THROUGH 28

The same equipment, materials and procedure used in Examples 18 through 21 were used except the tobacco blend used contained a higher concentration of native nitrate nitrogen (0.5 weight percent compared to the 0.1 weight percent for the blends of Examples 18–21). The palladium was added as $(NH_4)_2PdCl_6$ by the method described in Examples 18–21. The weight of salt added to the 500 ml of water along with the resulting concentration of metal, calculated as palladium metal are reported in Table VI.

The treated tobacco blends of Examples 18 through 28 were pyrolyzed according to the same method and procedure used in Example 6 and the results are reported in Table VI.

TABLE VI

| Example | Weight of $(NH_4)_2PdCl_6$ Added to 500 ml. $H_2O$, gms. | % Palladium* in Final Blend | Relative** PCAH/TDS |
|---|---|---|---|
| 18 (Control) | — | — | 100 |
| 19 | 0.33 | 0.02 | 86 |
| 20 | 1.0 | 0.06 | 60 |
| 21 | 2.0 | 0.12 | 63 |

TABLE VI-continued

| Example | Weight of $(NH_4)_2PdCl_6$ Added to 500 ml. $H_2O$, gms. | % Palladium* in Final Blend | Relative** PCAH/TDS |
|---|---|---|---|
| 22 (Control) | — | — | 100 |
| 23 | 0.33 | 0.02 | 82 |
| 24 | 0.50 | 0.03 | 75 |
| 25 | 0.65 | 0.04 | 61 |
| 26 | 0.83 | 0.05 | 63 |
| 27 | 1.0 | 0.06 | 62 |
| 28 | 2.0 | 0.12 | 57 |

*calculated as palladium metal

** $\frac{\text{PCAH/TDS for Sample mgm/gm}}{\text{PCAH/TDS for Control mgm/gm}} \times 100 = \text{Relative PCAH/TDS}$ relative values of milligrams While the invention has been described in detail with particular reference to preferred embodiments thereof, it will be understood that variations and modifications can be effected within the spirit and scope of the invention as described hereinabove and as defined in the appended claims.

We claim:

1. A smoking composition comprising tobacco and a water soluble chloride salt of palladium, said salt being decomposable into metallic palladium and associated with said tobacco in said composition in amounts of from about 0.001 to about 0.10 percent by weight, calculated as palladium metal, of said tobacco.

2. The composition of claim 1 wherein the particle size of said palladium associated with said tobacco is less than about 100 U.S. mesh.

3. The composition of claim 1 wherein the palladium salt is ammonium hexachloropalladate, $(NH_4)_2PdCl_6$.

4. The composition of claim 1 wherein the palladium salt is ammonium tetrachloropalladate, $(NH_4)_2PdCl_4$.

5. The composition of claim 1 wherein the weight proportion of said palladium associated with said tobacco is between about 0.01 percent and 0.06 percent, calculated as palladium metal, of said tobacco.

6. The composition of claim 1 wherein the particle size of said palladium associated with said tobacco is less than about 100 U.S. mesh.

7. The composition of claim 6 wherein the palladium salt is ammonium hexachloropalladate, $(NH_4)_2PdCl_6$.

8. The composition of claim 6 wherein the palladium salt is ammonium tetrachloropalladate, $(NH_4)_2PdCl_4$.

9. The method of making smoking compositions in which there is a decrease in the yield of polycyclic aromatic compounds arising from pyrolytic reactions of tobacco smoking compositions comprising the step of including in said smoking composition a catalytic agent for causing a decrease in the yield of polycyclic aromatic compounds arising from pyrolytic reactions of said composition, said agent consisting of finely divided water soluble chloride salt of palladium said salt being decomposable into metallic palladium and being associated with said tobacco in said composition in an amount of between 0.001 and 0.10 percent by weight of said tobacco, calculated as palladium metal.

* * * * *